US011020311B2

(12) United States Patent
Hotchkiss et al.

(10) Patent No.: US 11,020,311 B2
(45) Date of Patent: Jun. 1, 2021

(54) THERAPEUTIC DEVICE AND METHOD FOR STIMULATING THE ANATOMY OF THE CERVICAL SPINE AND NECK

(71) Applicants: Ronald G. Hotchkiss, Rockford, IL (US); Gregory S. Marler, Rockford, IL (US)

(72) Inventors: Ronald G. Hotchkiss, Rockford, IL (US); Gregory S. Marler, Rockford, IL (US)

(73) Assignee: Ronald G. Hotchkiss, Rockford, IL (US)

( * ) Notice: Subject to any disclaimer, the term of this patent is extended or adjusted under 35 U.S.C. 154(b) by 717 days.

(21) Appl. No.: 15/867,428

(22) Filed: Jan. 10, 2018

(65) Prior Publication Data

US 2018/0193222 A1 Jul. 12, 2018

Related U.S. Application Data

(60) Provisional application No. 62/444,701, filed on Jan. 10, 2017.

(51) Int. Cl.

| | |
|---|---|
| ***A61H 23/02*** | (2006.01) |
| ***A61H 15/00*** | (2006.01) |
| *A61G 13/12* | (2006.01) |

(52) U.S. Cl.

CPC ..... *A61H 23/0263* (2013.01); *A61H 15/0078* (2013.01); *A61G 13/121* (2013.01); *A61H 2015/0028* (2013.01); *A61H 2201/1215* (2013.01); *A61H 2205/04* (2013.01)

(58) Field of Classification Search

CPC ..... A61H 23/0254; A61H 23/0263; A61H 23/0272; A61H 23/0281; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 2201/1418; A61H 2201/1678

See application file for complete search history.

(56) References Cited

U.S. PATENT DOCUMENTS

| | | | | |
|---|---|---|---|---|
| 3,550,587 A | | 12/1970 | Kawada | |
| 3,882,856 A | * | 5/1975 | Heuser | A61H 15/0078 601/116 |
| 4,716,891 A | | 1/1988 | Yorgan | |
| 4,832,006 A | | 5/1989 | Kirsch | |
| 5,052,376 A | | 10/1991 | Yamasaki | |

(Continued)

FOREIGN PATENT DOCUMENTS

KR 200283018 7/2002

*Primary Examiner* — Bradley H Philips
*Assistant Examiner* — Savannah L Gabriel
(74) *Attorney, Agent, or Firm* — Leason Ellis LLP

(57) ABSTRACT

A therapeutic device for stimulating the anatomy of the cervical spine and neck is provided and includes a housing having an upper portion configured for receiving and cradling the cervical spine and the neck. The therapeutic device includes a motorized rotor assembly having a plurality of rollers. The rotor assembly rotating about a first axis and the plurality of rollers rotating independently from one another and about axes spaced from the first axis. The rotor assembly is configured to transmit percussive energy to the cervical spine and the neck.

14 Claims, 11 Drawing Sheets

(56) References Cited

U.S. PATENT DOCUMENTS

| | | | | |
|---|---|---|---|---|
| 5,271,386 | A * | 12/1993 | Thompson | A61H 15/0078 601/102 |
| 5,577,995 | A * | 11/1996 | Walker | A61H 15/0092 601/118 |
| 6,315,742 | B1 | 11/2001 | Howard | |
| 6,524,263 | B2 | 2/2003 | Chen | |
| 8,597,213 | B2 | 12/2013 | Han | |
| 2004/0210174 | A1* | 10/2004 | Kim | A61H 15/0078 601/99 |
| 2007/0255188 | A1* | 11/2007 | Tseng | A61H 7/007 601/94 |
| 2011/0004131 | A1* | 1/2011 | Han | A61H 1/0296 601/112 |
| 2011/0184324 | A1* | 7/2011 | Wu | A61H 7/007 601/112 |
| 2013/0253390 | A1 | 9/2013 | Park | |

* cited by examiner

Cervical Spine Posterior View

THERAPEUTIC DEVICE AND METHOD FOR STIMULATING THE ANATOMY OF THE CERVICAL SPINE AND NECK

CROSS-REFERENCE TO RELATED APPLICATION

The present application claims priority to U.S. patent application Ser. No. 62/444,701, filed Jan. 10, 2017, which is hereby incorporated by reference in its entirety.

TECHNICAL FIELD

The present invention is directed to a therapeutic device for stimulating the anatomy of the cervical spine and neck and more specifically, relates to a therapeutic device and method that provides a massaging function, transmits percussive energy, and optionally provides a vibratory treatment.

BACKGROUND

FIG. 7 shows the human head 10 with a cervical radius of curvature being identified at 20 and the neck at 25. With reference to FIG. 2, as is known, the cervical spine includes an intricate network of muscles, tendons, and ligaments that provide support and movement. These elements of the anatomy can spasm or become strained, which is a common cause of neck pain and stiffness. The spinal cord travels from the base of the skull through the cervical spine.

The cervical spine is comprised of seven vertebrae: C1, C2, C3, C4, C5, C6, and C7. These vertebrae begin at the base of the skull and extend down to the thoracic spine. The cervical vertebrae are cylindrical annular bones, through which the spinal cord travels, that stack up one on top of the other to make one continuous column of bones in the neck. As illustrated and defined herein, the term "facet joints" refers to paired joints located on opposing lateral sides of the spinous process that link a vertebra to its adjacent vertebrae. The facet joints allow the spine to move as a unit. The term "intervertebral disc" refers to one of the small, shock-absorbing cushions located between the vertebrae of the spine. The term "spinous process" refers to the lever-like backward projection extending off each vertebra to which muscles and ligaments are attached. The term "traction" is the process of putting a bone or other parts of the anatomy under a pulling tension to facilitate healing. The term "vertebra" is one of the cylindrical bones that form the spine.

SUMMARY

In accordance with one embodiment, a therapeutic device for stimulating the anatomy of the cervical spine and neck is provided and includes a housing having an upper portion configured for receiving and cradling the cervical spine and the neck. The therapeutic device includes a motorized rotor assembly having a plurality of rollers. The rotor assembly rotating about a first axis and the plurality of rollers rotating independently from one another and about axes spaced from the first axis. The rotor assembly is configured to transmit percussive and vibratory energy through the rollers to the cervical spine and the neck.

BRIEF DESCRIPTION OF THE DRAWING FIGURES

DETAILED DESCRIPTION OF CERTAIN EMBODIMENTS

Figure 1:
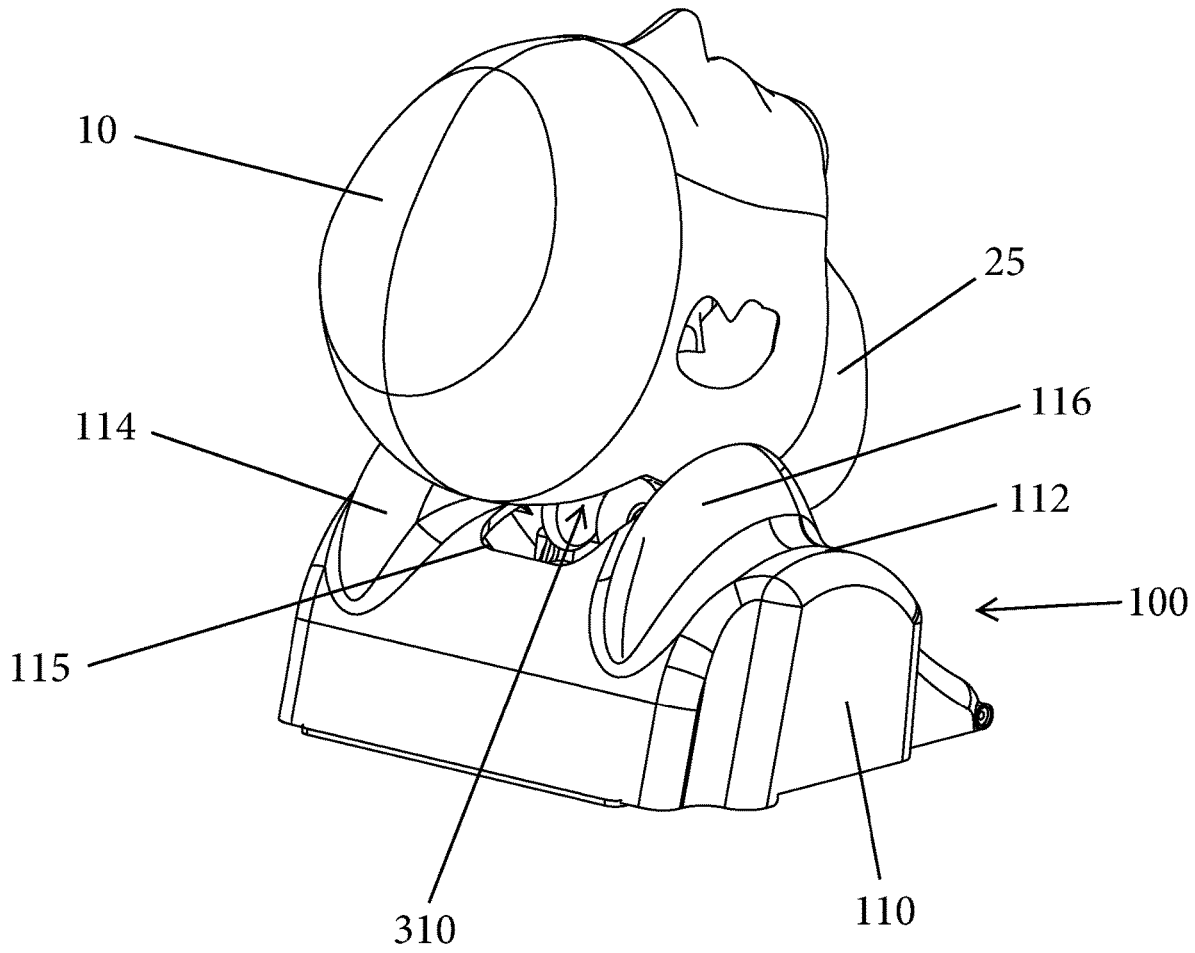
FIG. 1 is a rear and side perspective view of a therapeutic device for stimulating the anatomy of the cervical spine and neck according to a first embodiment.

FIGS. 1-11 illustrate the teachings of the present invention and more specifically, a therapeutic device 100 for stimulating the anatomy of the cervical spine and the neck. The therapeutic device 100 is intended to be a portable device that is placed on a support surface, such as a table, etc. As shown in FIG. 1, the therapeutic device 100 has an outer housing or casing 110 that not only contains the working components of the therapeutic device 100 but also is configured to provide an ergonomic interface between the user and the device 100. In particular, the housing 110 has an upper portion 112 that can have a curved surface (e.g., convex surface). The housing 110 includes a first neck cradle 114 and a second neck cradle 116 that is spaced therefrom. The first and second neck cradles 114, 116 are spaced apart a sufficient distance to allow the head 10 and neck 25 of the user to be received and contained therebetween. The first and second neck cradles 114, 116 follow the curvature of the upper portion 112 and therefore, each of the first and second neck cradles 114, 116 can be curved structures and can be formed as an integral part of the housing 110 or can be coupled thereto. The first and second neck cradles 114, 116 can, for example, be cushioned structures (e.g., contain foam or the like that is covered by a covering).

As discussed herein, the upper portion 112 can be height adjustable to control the intensity of the massage therapy.

While not shown, the housing 110 accommodates an electrical cord that extends from the housing 110 for insertion into a standard electrical outlet. As described herein, the power source can be an electrical outlet via an electrical plug or can be battery powered.

The housing 110 also has an opening 115 formed therein between the first neck cradle 114 and the second neck cradle 116. As described herein, the opening 115 can be formed to have a number of different shapes and sizes so long as the opening 115 provides access to working therapeutic components of the therapeutic device 100 as described herein. The opening 115 is thus preferably centrally located along the top surface of the upper portion 112 of the housing 110. The opening 115 in the illustrated embodiment thus has a degree of curvature since it is formed along the curved top surface of the housing 110.

Figure 3:
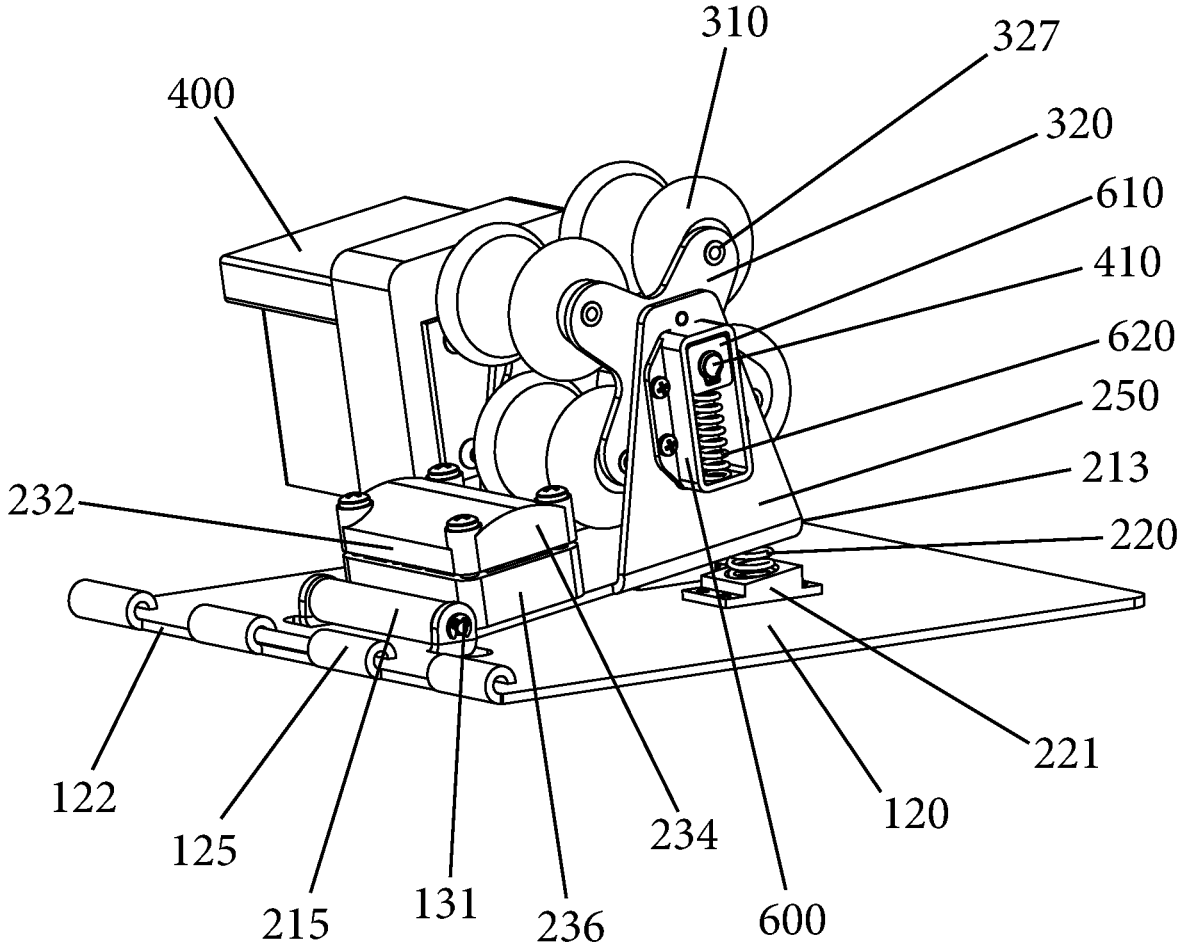
FIG. 3 is a side perspective view of the therapeutic device with an outer housing having been removed.

FIG. 3 shows the therapeutic device 100 with the housing 110 having been removed to show the working components of the therapeutic device 100. As shown, a first base plate 120 is provided and serves as the bottom of the therapeutic device 100 that rests on the support surface. The first base plate 120 can be formed to have any number of different shapes with the illustrate first base plate 120 having a rectangular shape defined by a first edge 122.

The housing 110, which can be thought of as being an upper housing, can be coupled to the first base plate 120 using conventional techniques. For example, the first edge 122 can include one or more hinges 125 that extend along a length thereof. The hinges 125 are configured to mate with complementary structures in the (upper) housing 110 to attach the upper housing 110 to the base plate 120. The hinged nature permits the housing 110 to pivot relative to the first base plate 120 to allow the housing 110 to move between an open position and a closed position. The first base plate 120 can thus be in the form of a planar structure that can sit on a flat support surface. As discussed herein, the device 100 is intended to be mobile and thus, the first base plate 120 comprises a bottom part of the device 100 and is placed on a suitable support surface.

The therapeutic device 100 also includes a motorized rotor assembly 200 that is coupled to the first base plate 120 and more particularly, is movably (e.g., pivotally) coupled to the first base plate 120. As described herein, the motorized rotor assembly 200 is the mechanism by which energy is transmitted to the cervical spine and neck. The motorized rotor assembly 200 includes its own base plate, namely, a second base plate 210 (a rotor bracket). The second plate 210 can be formed in different shapes and sizes; however, the size of the second base plate 210 is less than the first base plate 120 since the second base plate 210 rests on and lies within the footprint of the first base plate 120. In the illustrated embodiment, the second base plate 210, like the first base plate 120, has a rectangular shape. The second base plate 210 has a first edge 211 and a second edge 213 that is opposite the first edge 211.

The second base plate 210 is movably coupled to the first base plate 120 and more particularly, the second base plate 210 can be pivotally coupled to the first base plate 120. At the first edge 211 of the second base plate 210, a rotor hinge 215 is provided and mates with a complementary hinge structure that is associated with the first base plate 120 to permit the second base plate 210 to be hingedly (pivotally) coupled to the first base plate 120. For example, the first base plate 120 includes a pair of posts or flanges 129 and the rotor hinge 215 is disposed therebetween and a hinge pin 131 extends through the posts 129 and the rotor hinge 215.

Figure 11:
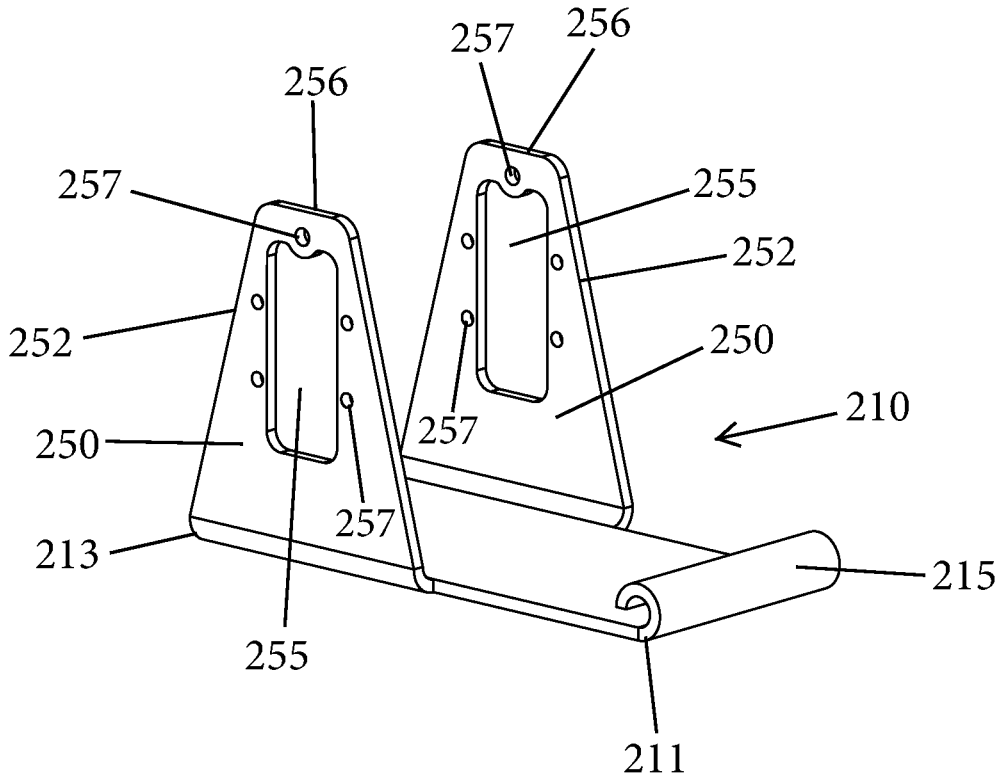
FIG. 11 is a side perspective view of the rotor bracket.

The rotor hinge 215 can be in the form of a curved lip as shown in FIG. 11. The hinges 125 and hinge 215 are thus located proximate one another. The second base plate 210 has a planar lower surface and a planar upper surface.

The second base plate 210 is also biased relative to the first base plate 120 and more particularly, a biasing element 220 is provided to bias the second base plate 210 relative to the first base plate 120. The biasing element 220 can be in the form of a cushion spring that is anchored to the upper surface of the first base plate 120. The biasing element 220 can have a base part (mount) 221 that is the part that is anchored to the first base plate 120 and includes a spring that protrudes upwardly from the base part toward and into contact with an underside (lower surface) of the second base plate 210. The biasing element 220 thus provides a biasing force to the second base plate 210. In particular, in a rest position, the biasing element 220 causes the second edge 213 of the second base plate 210 to be elevated relative to the first base plate 120 and more particularly, the second edge 213 is higher than the first edge 211 relative to the planar upper surface of the first base plate 120. It will be understood that when a force is applied to the second edge 213 of the second base plate 210 in a direction toward the first base plate 120, the biasing element (spring) 220 compresses and stores energy as the second base plate 210 moves toward the first base plate 120. Conversely, once this applied force is removed from the second base plate 210, the stored energy in the biasing element 220 is released causing the second base plate 210 to be driven in a direction away from the first base plate 120.

For reasons discussed herein, the second base plate 210 can be thought of as being a hinged plate that is pivotally coupled to the first base plate 120. Optionally, a vibration motor 230 is provided and is coupled to the second base plate (vibratory hinged plate) 210. The vibration motor 230 can be any number of commercially available motors that are configured to transmit vibratory energy to the second base plate 210. One exemplary vibration motor 230 can be an eccentric rotating mass vibration motor (ERM) uses a small unbalanced mass on a DC motor such that when it rotates, it creates a force that translates to vibrations. The vibration motor 230 can be disposed closer to the first edge 211 than the second edge 213 and extends across a width of the second base plate 210.

Figure 4:
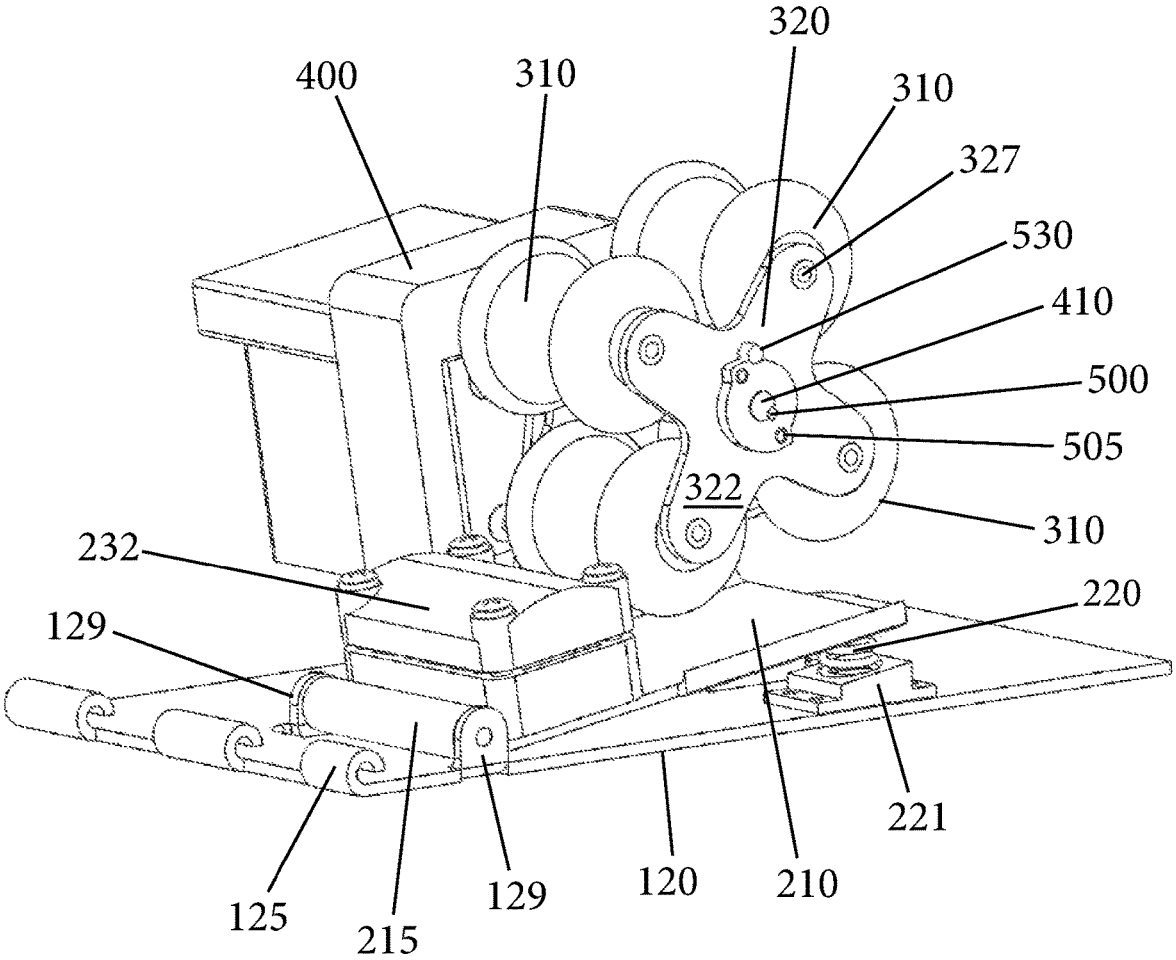
FIG. 4 is a side perspective view of the therapeutic device with a rotor bracket being removed.
Figure 10:
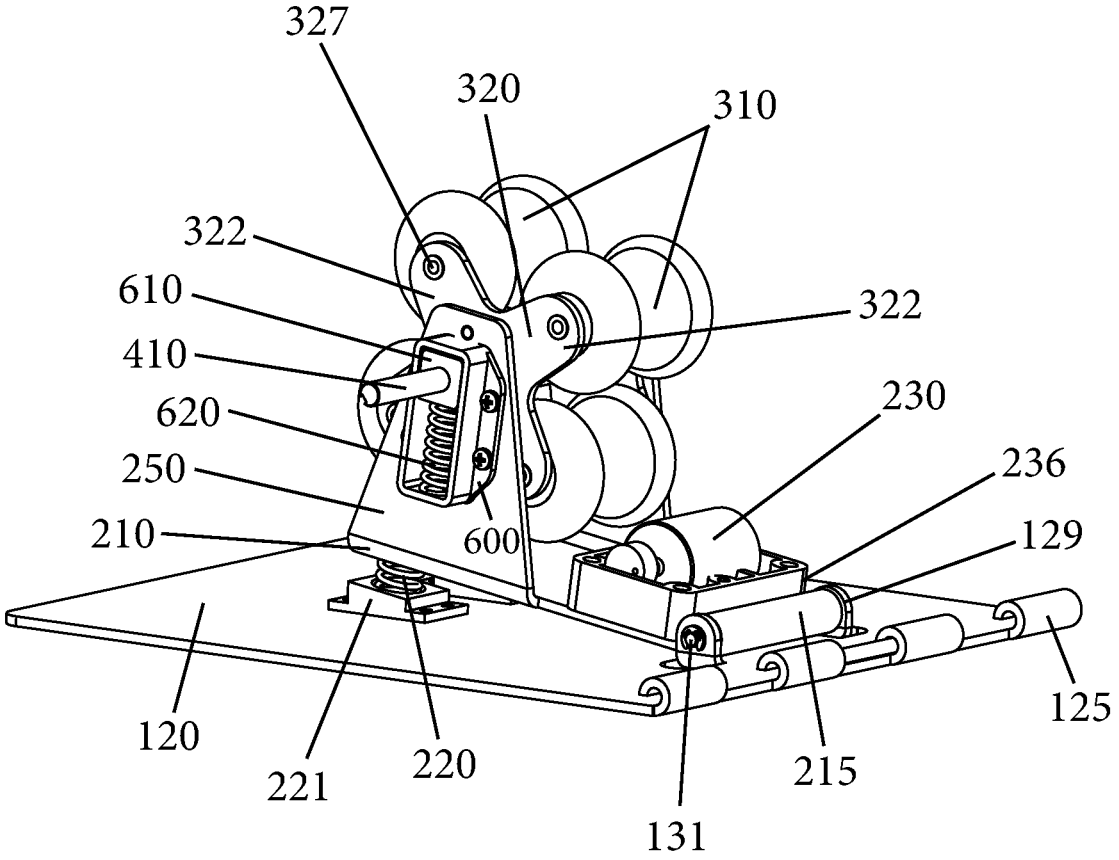
FIG. 10 is another side perspective view of the rotor assembly and rotor bracket with a drive shaft being shown.

As shown in FIGS. 3, 4 and 10, the vibration motor 230 can be disposed and contained within a motor housing 232 that can be formed of a first part (upper part) 234 and a second part (lower part) 236. The second part 236 is mounted to the top surface of the second base plate 210 as shown in FIG. 10. In FIG. 10, the first part 234 is removed to show the vibration motor 230 contained in the second part 236. The first part 234 and the second part 236 are attached to one another using conventional techniques, such as the use of fasteners.

As shown best in FIG. 11, the second base plate 210 (hinged plate or rotor bracket) has a pair of spaced side walls 250 that extend upwardly from two opposing sides (edges) of the second base plate 210. The pair of spaced side walls 250 are parallel to one another and are perpendicular to the planar top surface of the second base plate 210. The side walls 250 are typically identical and mirror images of one another. In the illustrated embodiment, each side wall 250 is generally triangular shaped in that the side wall 250 has opposing angled side walls 252 that taper inwardly in a direction away from the first base plate 120. The illustrated two side walls 252 do not intersect and come to a point but instead a top wall 256 extends between the top edges of the two side walls 252. The top wall 256 can be parallel to the top surface of the second base plate 210.

Each side wall 250 has a through hole (opening) 255 which can be formed to have any number of different shapes and in the illustrated embodiment, the opening 255 is generally rectangular shaped. The length of the opening 255 is oriented in a vertical direction in that it extends between the top surface of the second base plate 210 and the top wall 256. The opening 255 allows for passage and movement of the drive shaft 410 due to the operation of the percussive energy transfer mechanism. Each side wall 250 also has a plurality of holes 257 that are formed in the second base plate 210 and are arranged around the opening 255. For example, there can be two pairs of holes 257 along the sides of the opening 255 and a single hole 257 along the top edge of the opening 255. The openings 255 are axially aligned and the plurality of holes 257 are axially aligned.

As shown, the side walls 250 are located at and terminate at the second edge 213 of the second base plate 210.

The motorized rotor assembly 200 also includes a roller assembly 300 that is coupled to the second base plate 220. The rotor assembly 300 includes a plurality of rollers 310 that are supported by and connected to a pair of laterally opposing rotor hubs 320. As shown in the figures, the hubs 320 are in the form of plates that each includes a plurality of spokes 322 that extend radially outward from a center portion of the rotor hub 320. In the illustrated embodiment, there are four spokes 322 that are formed 90 degrees apart from one another. The rotor hub 320 can thus be formed in an X shape.

As described herein, the rotor assembly 300 is intended to be accessible through the opening 115 formed in the upper housing 100. For example, at least one roller 310 can be accessible and pass through the opening 115 to allow contact between the roller 310 and the neck tissue. According to one aspect of the present invention, the degree of which the roller 310 protrudes from the opening 115 is adjustable by adjusting the height of the upper housing 110 relative to the first base plate 120. In particular, the rear of the housing 110 can be adjusted in an up/down position as a result of the hinged connection to the first base plate 120 and on operation of the actuator or mechanism that permits adjustment. In one exemplary embodiment, there is an actuator for raising and lowering the upper housing 110. For example, thumbscrews can be provided as part of the upper housing 110 whereupon rotation of the thumbscrews causes raising and lowering of the upper housing 110 relative to the first base plate 120 due to contact between the thumbscrews and the top surface of the first base plate 120. Other mechanisms are equally possible for raising and lowering the upper housing 110.

Since movement of the upper housing 110 is separate from the rotor assembly 200, the rollers 310 remain in a rest position while the upper housing 110 is raised or lowered. This results in an alteration in the amount of the roller(s) 310 that are exposed in the opening 115 and more particularly, when the upper housing 110 is raised, less of the roller(s) 310 is exposed, and conversely, when the upper housing 110 is lowered, more of the roller(s) 310 is exposed.

The rotor hubs 320 are fixedly coupled to one another so that the two rotor hubs 320 rotate as a single unit. For example, a connector in the form of a cylindrical tube that extends between the center portions of the two rotor hubs 320.

The plurality of rollers 310 are disposed between the two hubs 320 and each roller 310 is rotatably coupled to the two spaced apart hubs 320 such that each roller 310 can independently rotate relative to the others. Each roller 310 is thus rotatably mounted to one of the spokes 322 of each hub 320. More specifically, a first roller 310 is rotatably mounted to a first pair of spokes 322 (that are spaced apart from one another and are aligned with one another); a second roller 310 is rotatably mounted to a second pair of spokes 322; a third roller 310 is rotatably mounted to a third pair of spokes 322; and a fourth roller 310 is rotatably mounted to a fourth pair of spokes 322. As shown in the figures, each roller 310 rotates integrally with a pair of roller shafts/bushings 327 that extend between the respective pairs of spokes 322. As described in more detail herein, each roller 310 can rotate independently from the other rollers 310. As shown in the figures, the roller shafts/bushings 327 can be in the form of a shaft that passes through the center of the roller with ends of the shaft extending outwardly from each end of the roller 310. For example, the roller shafts/bushings 327 can be cylindrically shaped and are intended to be inserted into openings formed in the spokes 322 of the rotors 320 (the roller shafts/bushings 327 freely rotate within these openings). It will be appreciated that other shaft constructions can be used including formation of end protuberances on the roller 310 with the end protuberances being inserted into the openings formed in the spokes 322 of the rotors 320.

The connector (e.g., cylindrical tube) that extends between the center portions of the two rotor hubs 320 is located free of contact and interference with the rollers 310.

The motorized rotor assembly 200 also includes a drive unit 400, such as a motor, that includes a drive shaft 410 that protrudes and extends outwardly from a casing 405 that contains the motor itself. The drive shaft 410 is best shown in FIG. 10. The drive unit 400 can be any number of suitable motors, such as a AC motor or the like. The drive unit 400 is disposed along one of the rotor hubs 320 and is positioned such that the drive shaft 410 passes through center holes 329 formed in the rotor hubs 320. The drive shaft 410 thus passes between the rollers 310 and is not in contact with any of the rollers 310. The drive shaft 410 is thus coupled to the two rotor hubs 320 such that rotation of the drive shaft 410 is translated into rotation of the two rotor hubs 320 as a single unit. Operation of the motor thus provides a means for controllably rotating the rotor assembly 300 in a controlled manner. The drive shaft 410 can be attached to the two rotor hubs 320 using any number of conventional techniques, such as a keyed connection between the drive shaft 410 and the two rotor hubs 320.

The connector (e.g., a cylindrical tube) that extends between the center portions of the two rotor hubs 320 accommodates the drive shaft 410 in that the drive shaft 410 passes through the hollow center of the connector.

It will be understood that the direction of rotation and the speed of rotation of the rotor assembly 300 can be varied by varying the manner in which the motor operates, including direction of rotation of the drive shaft 410 and the speed of rotation of the drive shaft 410.

Adjacent to each rotor hub 320 is a snail style cam 500. The cam 500 is positioned along an outer face of the rotor hub 320 and is mounted to the drive shaft 410 such that rotation of the drive shaft 410 causes not only rotation of the rotor hubs 320 but also the cams 500 mounted thereto. Each cam 500 resembles a disk with a center opening through which the drive shaft 410 passes. As best shown in FIG. 4, each cam 500 includes at least one and preferably a plurality (e.g., two) cams surfaces 505 that are spaced apart from one another (e.g., 180 degrees apart). The cam 500 can be mounted to the rotor hub 320 by means of one or more fasteners and in the illustrated embodiment (See, FIG. 8), a pair of pins or studs 508 can be used to mount the cam 500 to the outer face of the rotor hub 320. The pins 508 can be oriented 180 degrees apart.

As the cam surfaces 505 of the cams 500 rotate, they contact stationary cam pins 530 which are fixed to inner surfaces of the side walls 250 that form part of the second base plate 210 (rotor bracket). In particular, the stationary cam pins 530 can be press-fit into the topmost hole 257 formed in the side wall 250.

It will be understood that instead of the drive shaft 410 being directly attached to the two rotor hubs 320, the drive shaft 410 can be directly attached to the two cams 500 as by a keyed connection between the drive shaft 410 and the cams 500. The result, like the alternative arrangement discussed previously, is the same in that rotation of the drive shaft 410 is translated into rotation of the rotor assembly 300 (including the rotor hubs 320 and rollers 310).

Floating Nature of the Motor Unit and the Rotor Assembly

In accordance with the present invention, both the motor unit 400 and the rotor assembly 300 float in that they are coupled only to the rotor bracket 210 which is support by the biasing element 220 and thus, both structures are movable in the up and down directions relative to the first base plate 120. The floating nature of the rotor assembly 300 enhances the vibration energy that can be transmitted to the user's neck tissue since the rotor bracket 210 is not rigidly connected to the first base plate 120 but instead is permitted to move (pivot) about the hinge 215.

Percussive Energy Transfer

The therapeutic device 100 also includes a percussive energy transfer mechanism for delivering percussive energy to the neck 25 of head 10. The mechanism includes a pair of percussive slide housings 600 that are mounted to the outer faces of the two side walls 250 of the rotor bracket 210. Each percussive slide housing 600 can be mounted to the outer face of the respective side wall 250 using conventional techniques, such as fasteners. For example, the percussive slide housing 600 includes holes that axially align with a set of the holes 257 (the ones on either side of the opening 255) and fasteners, such as screws, pass therethrough to mount to the percussive slide housing 600 to the outer face of the side wall 250. Each percussive slide housing 600 includes a hollow interior space that contains a percussive slide 610 that is mounted to the drive shaft 410 and is biased by a biasing element (percussive slide spring) 620. The percussive slide 610 is slidably contained within the percussive slide housing 600 such that it can slide and move in an axial direction. The percussive slide 610 is coupled to the drive shaft 410 and thus the two move together as a single structure. The percussive slide 610 is located at one end of the hollow interior space, while the biasing element 620 is located at the other end of the hollow interior space. One end of the biasing element 620 seats against the end of the hollow interior space and the other end seats against and applies a biasing force to the percussive slide 610. In a rest position, the biasing element 620 forces the percussive slide 610 to one end of the hollow interior space.

The rotor drive shaft 410 thus passes through two opposing slide mechanisms each mounted to a vertical support (i.e., side walls 250) of the rotor bracket 210. The rotor is mechanically captured by the rotor bracket 210 in a way allowing only perpendicular translation of the rotor with respect to the horizontal surface (upper surface) of the rotor bracket 210. This perpendicular translation allows for the transmission of percussive energy to the neck. More specifically, the percussive slides 610 are mounted vertically relative to the horizontal surface of the rotor bracket 210 and thus, the sliding action is along an axis that is perpendicular to the horizontal surface. Since the percussive slides 610 are fixedly attached to the motor shaft 410, the percussive slides 610 move together with the motor shaft 410.

As previously mentioned, as the drive shaft 410 rotates, the cams 500 rotate into contact with the stationary cam pins 530 (which are fixed to the side walls 250) and this causes the drive shift 410/rotor assembly 300/motor assembly 400 to translate downward toward the upper surface of second base plate 210 (hinged mounting plate), while simultaneously compressing the two slide springs 620. Rotation of the drive shaft 410 eventually causes the peak of the cams 500 to rotate past the stationary cam pins 530 instantaneously releasing the stored energy in the slide springs 620 allowing them to propel or translate the drive shaft 410/rotor assembly 300/motor assembly 400 upward perpendicular to the upper surface of the second base plate 210 (hinged mounting plate) and toward the user's neck 25. It is this repetitive instantaneous translation into the user's neck 25 that gives a percussive sensation.

As discussed here and illustrated in the accompanying drawings, the rotor drive shaft 410 is driven the electric gear motor (drive unit 400) and is mechanically coupled to the motor such that the motor translates in direct correlation to the rotor. The entire dynamic mechanism described above is then coupled to the first base plate 120 using a hinge mechanism allowing it to rotate about the hinge pin translating upwardly and downwardly as needed. The hinged mounting plate (second base plate 210) rests upon the cushion springs (one pair of springs) 220, thereby allowing for the upward and downward motion and user comfort. The neck cradle (upper housing 110) is mounted on the first base plate 120 and can be adjustable either up or down with respect to the rotor and user preference regarding massage intensity.

Roller Construction

The rollers 310 are intended to rotate as a result of frictional contact with the neck 25 so as to not allow the roller 310 to slide or skid across the skin of the neck 25, causing friction and discomfort. The rollers 310 are designed to roll freely up or down the neck 25, similar to a tire rolling freely across pavement.

Figure 2:
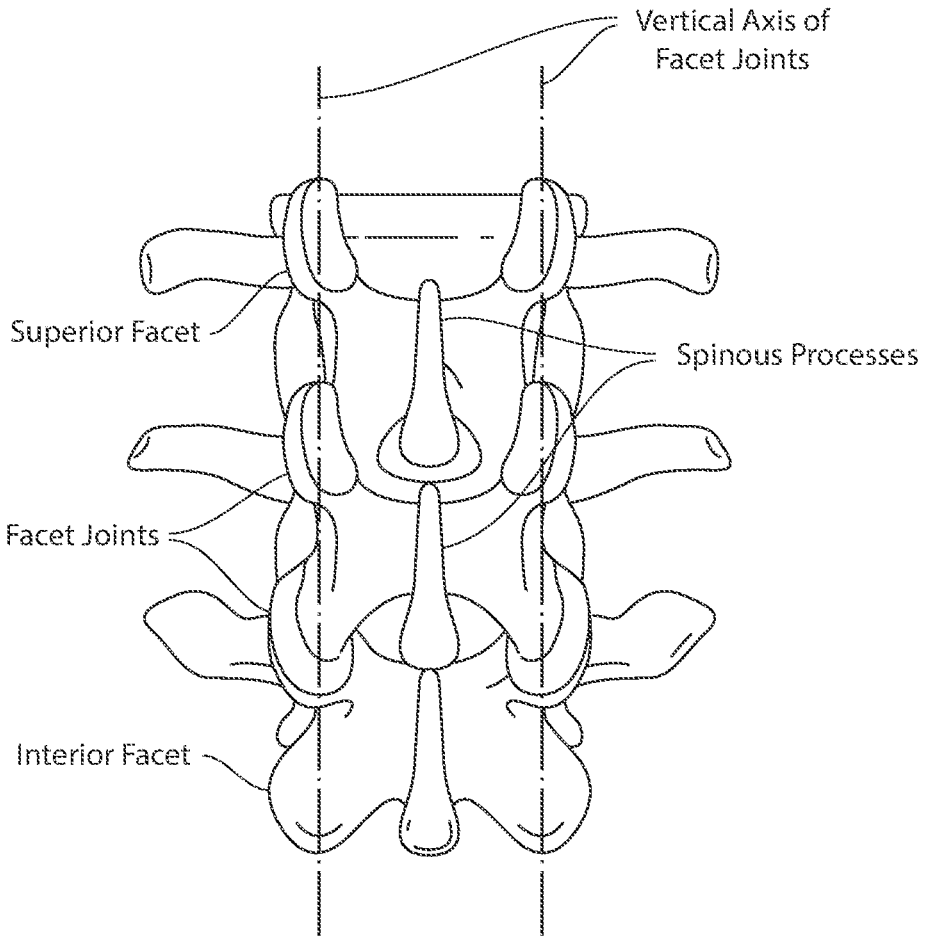
FIG. 2 is a posterior view of the cervical spine.
Figure 5:
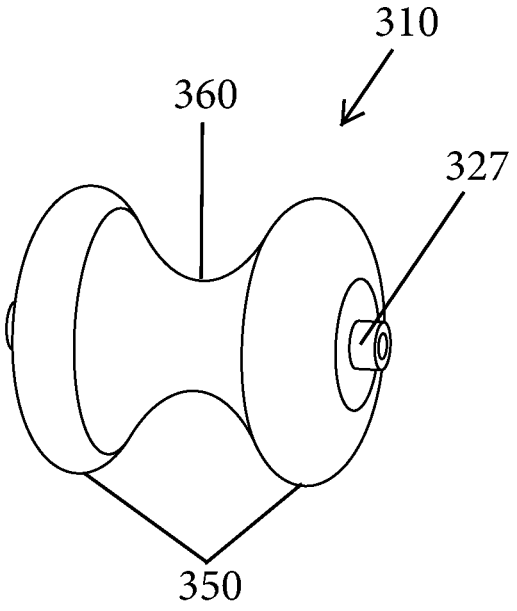
FIG. 5 is a perspective view of one exemplary roller.
Figure 6:
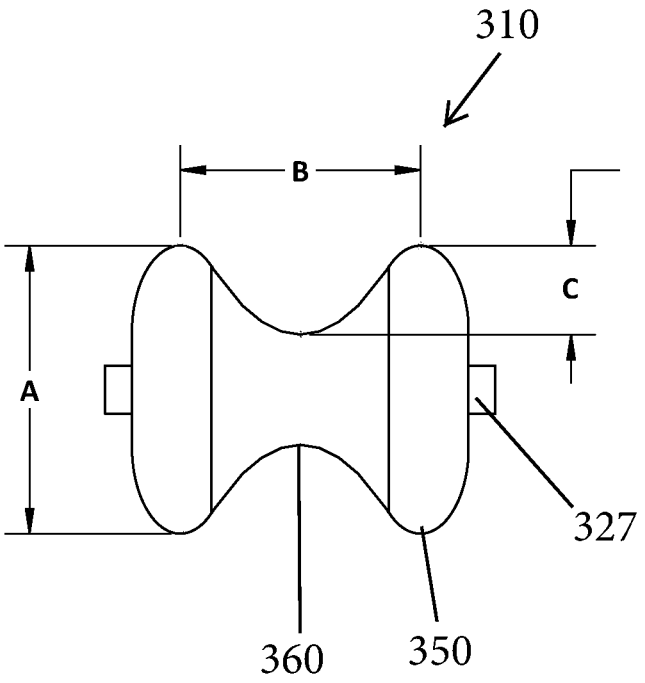
FIG. 6 is a side elevation view of the roller.
Figure 7:
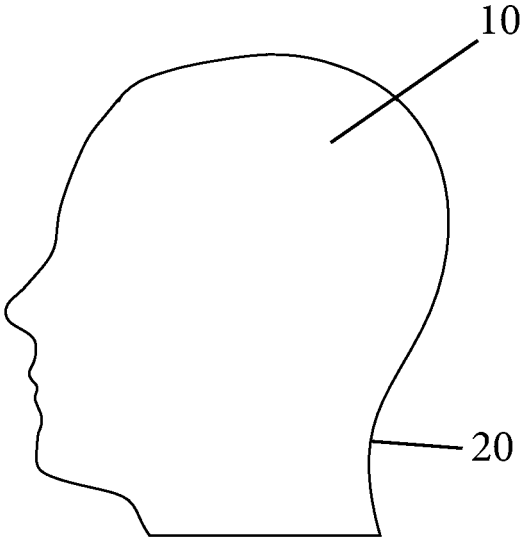
FIG. 7 is a schematic of a human head showing the neck and cervical spine area.
Figure 8:
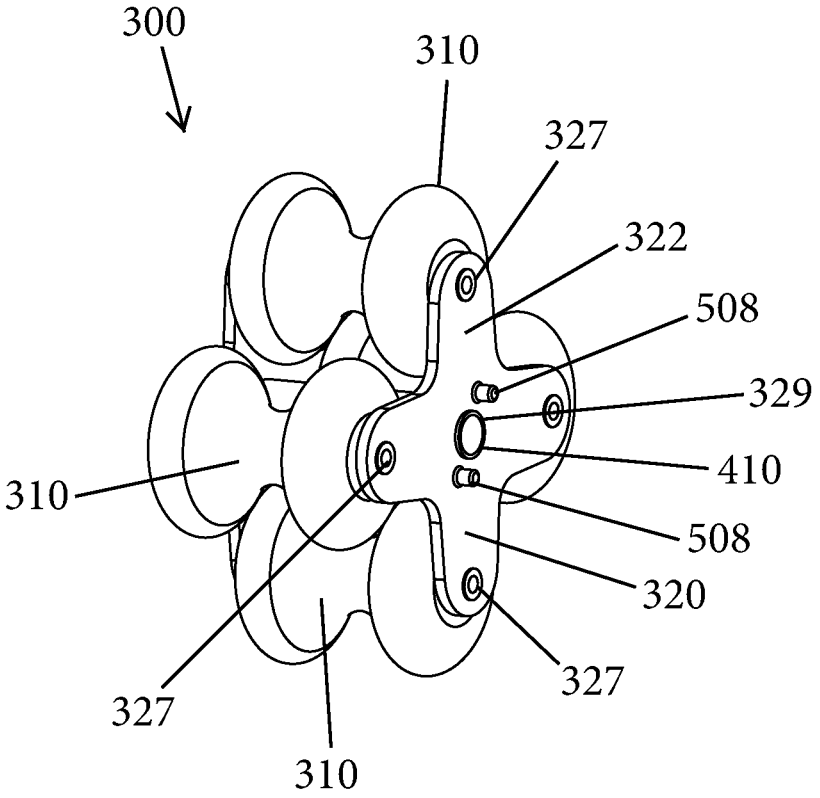
FIG. 8 is a side perspective view of an exemplary rotor assembly.

As shown in particular in FIGS. 5 and 6, each roller 310 is contoured to provide anatomical relief or clearance for spinous processes (FIG. 2). Each roller 310 has a pair of roller contact lobes 350 with a relief 360 being located therebetween. The relief 360 is thus a relief for the spinous processes. The roller 310 is constructed specifically to contact the facet joints with the lobes 350, while the relief 360 accommodates the spinous processes during the rolling action. In other words, the roller 310 has been purposely contoured and sized such that when the lobes 350 seat against the facet joints of the cervical spine, the spinous processes are not contacted by the roller 310 due to their reception within the relief 360. The facet joints thus represent the targeted anatomy that is treated by operation of the therapeutic device 100.

The rollers 310 can be formed of any number of different suitable materials and in one embodiment, the rollers 310 are semi-rigid in nature and in particular, the rollers 310 can be formed from an elastomer material, rubber, urethane material, etc. It will also be understood that the rollers 310 can come in different sizes to accommodate different anatomies (neck sizes, etc.). For example, rollers 310 could be provided in small, medium and large sizes.

It will also be understood that the rollers 310 do not have to have the same construction as one another but instead, the rollers 310 can have multiple different constructions, shapes, or sizes.

In one exemplary embodiment and as shown in FIG. 6, the diameter (A) of the roller 310 is about 1.50 inches and a recess depth (C) is about 0.46 inches and this construction allows for adequate relief so that the rollers 310 do not come into contact with the spinous processes. Roller contact with the spinous processes could cause discomfort and unwanted cervical deflection to one side or to the other dependent upon the location of contact.

Figure 9:
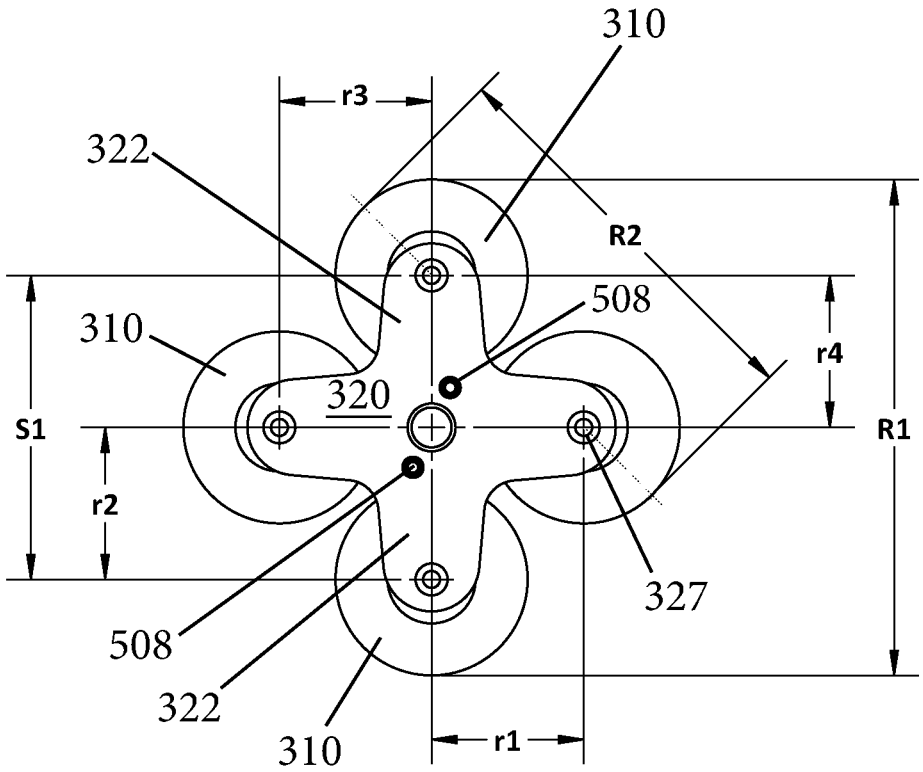
FIG. 9 is a side elevation view of the roller assembly.

Each roller 310 is contoured to provide anatomical contact along the vertical axes of the spinal facets (FIG. 2), while rolling from the lower neck to the upper neck. The roller lobe width (B) (which is about 1.25 inches) is designed to correlate with the average anatomical distance between the vertical axes of the facet joints. As shown in FIG. 9, the rotor diameter (R1) is designed to have a 1:1 ratio with the average at rest cervical radius of curvature 20, thereby providing for optimal positioning and comfort.

The timing and amplitude of the physiological undulations imparted by the rotor assembly 300 are modulated by a number of design elements, some of which are fixed and some of which are adjustable. The frequency or timing of undulations is regulated by motor rpm (motor unit 400), which may be fixed by design or manually adjustable using a variable speed drive mechanism. Timing of undulation can also be controlled in the design by the number of rotor roller elements (rollers 310). The amplitude of the cervical undulation is dictated by several factors in the design, namely a) the number of rotor roller elements (rollers 310); b) the distance of the center-line axis of each roller element (roller 310) with respect to the center-line axis of the rotor assembly 300 (see r1, r2, r3, and r4 of FIG. 9); and c) the distance between the axis of rotation of each roller 310 and the axis of rotation of the rotor 320 in relation to the corresponding distance associated with adjacent rollers (r1, r2, r3 and r4). It will also be appreciated that this distance can vary from roller 310 to roller 310.

In addition, roller contact pressure can be adjusted by changing the height of the neck cradles 114, 116 and upper housing 110 with respect to the height of the rotor 320. To ensure comfort and safety, the entire rotor/motor assembly is hinged and mounted on springs 220 allowing it to self-adjust its position based upon human contact (i.e., application of force due to head and neck movement). This provides a cushioning effect when positioning the neck onto the rollers 310.

To generate the percussive effect of the rollers 310, the rotor assembly 300 is spring loaded with two compressive springs 620 located lateral to the rotor assembly 300. The springs 620 are compressed as the rotor assembly 300 rotates using two opposing snail/drop cam mechanisms, also located lateral to the rotor hubs 320. As the rotors 300 rotate, it is retracted away from the neck as the springs 620 are compressed and then virtually instantaneously released back toward the neck creating the percussive response and accompanying physical sensation. The intensity of percussion is modulated by the following design factors: a) the stiffness of the compression springs 620; b) the radius of the cam circle; c) the height of the peak of the cam profile; and d) the angle of the drop after the peak. The timing of percussion can be modulated by the following factors: a) the number of cam peaks and b) the number of rotor rotations per minute (rpm).

It will be appreciated that the rotors 320 are actively driven by the motor unit 400, while the rollers 310 themselves are passively driven as a result of contact with the skin of the user as well as the rotation of the rotors 320 themselves.

It will also be understood that the device 100 can include one or more switches or actuators for controllably turning on and off the unit. In addition, it can be appreciated that the vibration motor can be controlled separate from the motor unit 400 that controls rotation of the rotor assembly. In this way, the user can disable the vibration mode if desired. It will also be appreciated that heating elements (conductive wires, etc.) can be incorporated into the upper portion of the housing 110 and in particular, in the cradles 114, 116.

Advantages and Exemplary Applications

The present invention provides a number of advantages over prior art treatments including, but not limited to, the following: 1) muscular relaxation; 2) increased localized blood flow; 3) increased localized dispersion of interstitial fluid; 4) improved flexibility and mobility; 5) increased joint elasticity; 6) improve cervical curve over time; 7) pain reduction; 8) improved sleep response; and 9) better quality of life.

The therapeutic device 100 can be used in a number of different applications including, but not limited to, neck massage and post-surgical therapy. In one exemplary embodiment, the therapeutic device 100 can have the following dimensions: 9×10×6.5 inches. However, this is merely exemplary and the device 100 can be formed in other sizes.

It will be understood that the foregoing dimensions are only exemplary in nature and therefore are not limiting of the present invention.

It is to be understood that like numerals in the drawings represent like elements through the several figures, and that not all components and/or steps described and illustrated with reference to the figures are required for all embodiments or arrangements.

The subject matter described above is provided by way of illustration only and should not be construed as limiting. Various modifications and changes can be made to the subject matter described herein without following the example embodiments and applications illustrated and described, and without departing from the true spirit and scope of the present disclosure, which is set forth in the following claims.

What is claimed is:

1. A therapeutic device for stimulating the anatomy of the cervical spine and neck of a user comprising:

a housing having an upper portion configured for receiving the cervical spine and neck of the user; and a motorized rotor assembly at least partially contained within the housing and having a plurality of rollers, the motorized rotor assembly rotating about a first axis; the plurality of rollers being coupled to and disposed between a pair of rotor hubs, the plurality of rollers rotating independently from one another and about axes that are spaced from the first axis, wherein the motorized rotor assembly is configured to transmit rotary/rolling and percussive energy to the cervical spine and the neck; wherein the housing-includes a first base plate that represents a bottom of the therapeutic device and is configured to attach to the upper portion, and the pair of rotor hubs are rotatably supported by a rotor bracket that is movably coupled to the first base plate;

wherein the rotor bracket comprises a second base plate and a pair of upstanding side walls that extend upwardly from the second base plate, the pair of rotor hubs and the plurality of rollers being disposed between the upstanding side walls;

wherein the therapeutic device further includes a pair of cams that are disposed along outer faces of the pair of rotor hubs and are coupled to a drive shaft of a motor that drives the rotor hubs, each cam having at least one cam surface that selectively contacts a cam pin that is fixedly attached to an inner face of one of the side walls to cause translation of the rotor assembly relative to the second base plate.

2. The therapeutic device of claim 1, wherein the upper portion of the housing includes an opening through which at least one roller passes to allow contact between at least one roller and the neck of the user.

3. The therapeutic device of claim 2, wherein the upper portion includes a first neck cradle and a second neck cradle with the opening being formed between the first neck cradle and the second neck cradle, the first neck cradle and the second neck cradle having arcuate shapes.

4. The therapeutic device of claim 1, wherein the motorized roller assembly includes a motor unit that has a motor and a motor drive shaft that is operatively coupled to the pair of rotor hubs for causing controlled rotation of the pair of rotor hubs.

5. The therapeutic device of claim 4, wherein each rotor hub includes a center portion through which the drive shaft passes and a plurality of spoke sections extending radially outward from the center portion, wherein each rotor hub is connected between one spoke of one rotor hub and one spoke of the other rotor hub.

6. The therapeutic device of claim 5, wherein each end of each roller has a roller shaft extending outwardly therefrom, each roller shaft being received within an opening formed in one of the respective rotor hubs to allow each roller to freely rotate between the pair of rotor hubs.

7. The therapeutic device of claim 1, wherein the motorized rotor assembly includes a motor unit that has a motor and a motor drive shaft that is operatively coupled to the pair of rotors hubs for causing controlled rotation of the pair of rotor hubs, the motor drive shaft passing through the pair of rotor hubs and the pair of upstanding side walls to permit the rollers to rotate in unison between the pair of upstanding side walls.

8. The therapeutic device of claim 1, wherein the second base plate is pivotally coupled to the first base plate and a biasing element is provided between the second base plate and the first base plate and applies a biasing force against an underside of the second base plate.

9. The therapeutic device of claim 1, further including a percussive side mechanism comprising a pair of percussive slide housings mounted to outer faces of the upstanding side walls of the second base plate, wherein each percussive slide housing including a percussive slide operatively coupled to the drive shaft of the motor and biased in the percussive slide housing by a biasing element that is disposed between one end of the percussive slide housing and the percussive slide and applies a biasing force to the percussive slide, the percussive slide being permitted to slidingly travel within the percussive slide housing in a first direction as a result of the at least one cam surface contacting the cam pin and in a second direction when the at least one cam surface passes and is free of contact with the cam pin.

10. The therapeutic device of claim 8, further including a vibration motor that is coupled to the second base plate and transmits vibrational energy to the second base plate and rotor assembly for providing a vibration treatment to the neck.

11. The therapeutic device of claim 9, wherein each of the pair of upstanding side walls includes a slot for receiving the drive shaft of the motor and permitting axial movement of the drive shaft of the motor as a result of the transmission of percussive energy.

12. The therapeutic device of claim 1, wherein each roller includes a pair of roller contact lobes with a center relief portion for accommodation of spinal processes.

13. The therapeutic device of claim 12, wherein at least one roller has a roller diameter of about 1.50 inches; a recess depth of about 0.46 inches and a roller lobe width of about 1.25 inches.

14. A therapeutic device for stimulating the anatomy of the cervical spine and neck of a user comprising:

a housing having an upper portion configured for receiving the cervical spine and neck of the user and having an opening formed therein;

a motorized rotor assembly at least partially contained within the housing and having a plurality of rollers that are supported on a rotor bracket, with at least one roller protruding from the opening in the housing, the motorized rotor assembly rotating about a first axis; the plurality of rollers being coupled to and disposed between a pair of rotor hubs, the plurality of rollers rotating independently from one another and about axes that are spaced from the first axis, wherein the motorized rotor assembly transmits rotary energy to the cervical spine and the neck as a result of repeated contact between the plurality of rollers and the neck; and a percussive energy transfer mechanism comprising a pair of cams that are mounted to outer faces of the rotor hubs and fixed cam pins that protrude inwardly from the rotor bracket and are positioned to selectively contact the cams as the motorized rotor assembly rotates resulting in the motorized rotor assembly moving in an up and down direction which is translated into transmission of percussive energy to the cervical spine and the neck.

* * * * *